US008695126B2

(12) United States Patent
Yoneda et al.

(10) Patent No.: US 8,695,126 B2
(45) Date of Patent: Apr. 15, 2014

(54) FLUSH TOILET WITH SLOPED SURFACES FOR IMPROVED WASTE REMOVAL

(75) Inventors: Toshifumi Yoneda, Fukuoka (JP); Masaaki Inoue, Fukuoka (JP); Yu Yamasaki, Fukuoka (JP)

(73) Assignee: ToTo Ltd., Fukuoka (JP)

( * ) Notice: Subject to any disclaimer, the term of this patent is extended or adjusted under 35 U.S.C. 154(b) by 0 days.

(21) Appl. No.: 13/548,700

(22) Filed: Jul. 13, 2012

(65) Prior Publication Data

US 2013/0019391 A1 Jan. 24, 2013

(30) Foreign Application Priority Data

Jul. 14, 2011 (JP) ..... 2011-155619

(51) Int. Cl.
*E03D 11/00* (2006.01)

(52) U.S. Cl.
USPC ..... 4/420; 4/429; 4/421

(58) Field of Classification Search
USPC ..... 4/420, 421, 429, 440, 442, 329
See application file for complete search history.

(56) References Cited

U.S. PATENT DOCUMENTS

| | | | | |
|---|---|---|---|---|
| 4,734,943 | A * | 4/1988 | Mellinger et al. | 4/300 |
| 6,145,138 | A * | 11/2000 | Nakamura et al. | 4/425 |
| 2003/0140406 | A1 | 7/2003 | Miwa et al. | |
| 2005/0166308 | A1 | 8/2005 | Miwa et al. | |

FOREIGN PATENT DOCUMENTS

| | | | |
|---|---|---|---|
| EP | 0407609 | A1 | 1/1991 |
| JP | 02-190539 | | 7/1990 |
| JP | 06-053675 | U | 7/1994 |
| JP | 08-120741 | | 5/1996 |
| JP | 11-061950 | | 3/1999 |
| JP | 2001-303650 | A | 10/2001 |
| JP | 2008-045276 | A | 2/2008 |
| JP | 2009-287331 | A | 12/2009 |
| JP | 2010-031551 | A | 2/2010 |

OTHER PUBLICATIONS

Japanese Notice of Allowance; JP2011-155619; Aug. 23, 2012.

* cited by examiner

*Primary Examiner* — Huyen Le
*Assistant Examiner* — Erin Deery
(74) *Attorney, Agent, or Firm* — Studebaker & Brackett PC

(57) ABSTRACT

A flush toilet includes a bowl portion having a waste receiving surface, a rim portion, spout portions for spouting flush water supplied from a reservoir tank into the bowl portion, and a water discharge trap pipe for discharging waste. The water discharge trap includes an inlet connected to a bottom of the bowl portion. The bowl portion waste receiving surface includes an upper waste receiving surface connected to the rim portion, and a concave portion connected between the upper waste receiving surface and the discharge trap pipe. The concave portion includes a bottom surface connected to the discharge trap pipe and is positioned below the upper waste receiving surface, and a wall surface connecting the bottom surface and a bottom edge portion of the upper waste receiving surface. A front region of this wall surface forms a sloped surface sloping on the inside from bottom to top.

7 Claims, 14 Drawing Sheets

FLUSH TOILET WITH SLOPED SURFACES FOR IMPROVED WASTE REMOVAL

TECHNICAL FIELD

The present invention relates to a flush toilet, and more particularly to a flush toilet in which a toilet main unit is cleaned by flush water supplied from a flush water supply means, thereby discharging waste.

BACKGROUND ART

Known flush toilets in which the toilet main unit is flushed with flush water supplied from a flush water supply means to discharge waste have included those in which, as shown for example in Patent Document 1 (Japanese Patent Unexamined Publication No. 2010-31551), openings in rim spout portions are formed in an elongated flat shape in the horizontal direction of the toilet main unit, and a swirl flow swirling on the outer perimeter side of the bowl portion and a falling flow flowing in the direction of the reservoir portion are formed by causing the bottom surface of the rim spout portion openings to slope downward toward the reservoir portion side. Whereas a swirl flow of this type effectively guides waste and the like adhering to the waste receiving surface toward the reservoir portion side, the falling flow pushes waste floating on the reservoir portion surface to the inside of the discharge trap pipe and discharges waste.

SUMMARY OF THE INVENTION

Technical Problem

In the above-described flush toilet of Patent Document 1, however, when the flush water amount used for toilet flushing is set at a low level consistent with the requirement in recent years to conserve water in flush toilets, the amount of flow of flush water flowing from the bowl portion into the discharge trap pipe is also reduced, leading to the problem that waste cannot be sufficiently discharged and remains in the toilet main unit, such that sufficient toilet flushing function and waste discharge function are not attained.

The present invention was thus undertaken to solve the above-described technical problems, and has the object of providing a flush toilet with which a comparatively large amount of flush water can be caused to flow from the bowl portion into the discharge trap pipe even when the amount of flush water used in the flush toilet is set at a low level, enabling waste discharge performance to be improved.

Solution to Problem

The above object is achieved according to the present invention by providing a flush toilet in which a toilet main unit is cleaned by flush water supplied from a flush water supply means, thereby discharging waste, the flush toilet comprising: a bowl portion including a waste receiving surface and a rim portion positioned at the top edge portion thereof, a spout portion for spouting flush water supplied from the flush water supply means to the bowl portion, and a water discharge path for discharging waste, the inlet to which is connected at the bottom of the bowl portion; whereby the waste receiving surface on the bowl portion includes an upper waste receiving surface connected to the rim portion, and a concave portion connected between this upper waste receiving surface and the discharge trap pipe; and the concave portion includes a bottom surface connected to the discharge trap pipe and positioned below the upper waste receiving surface, and a wall surface connecting the bottom portion with the bottom edge portion of the upper waste receiving surface; and the front region of this wall surface forms a sloped surface sloping from bottom to top and to the inside.

In the present invention thus constituted, of the flush water spouted from the spout portion and flowing into the concave portion of the waste receiving surface on the bowl portion, flush water flowing from the bottom surface of the concave portion toward the front region of the concave portion side wall flows from bottom to top along the sloped surface of the front region of the concave portion side wall and toward the inside of the concave portion, therefore a flow swirling in the vertical direction within the concave portion is formed without spreading horizontally on the upper waste receiving surface at the outside of the concave portion. Thereafter, this vertically swirling flow of flush water can, by flowing at high flow force into the inlet of the discharge trap pipe, cause a comparatively large amount of flush water to flow into the discharge trap pipe, thus improving waste discharge performance.

In the present invention, the water spout portion preferably forms a water conduit including an elongated, flat flow path cross section in the horizontal direction of the toilet main unit so that spouted flush water forms a swirl flow on the outer circumference of the bowl portion, and a falling flow falling in the direction of the concave portion, and the bottom surface of this water conduit includes a sloped portion sloping downward toward the concave portion side of the waste receiving surface of the bowl portion.

In the present invention thus constituted, flush water spouted to the bowl portion from the water conduit in the spout portion including an elongated, flat flow path cross section in the horizontal direction of the toilet main unit forms a flow (the swirl flow) which swirls on the outer circumference side of the bowl portion (e.g., the rim portion or the upper waste receiving surface of the bowl portion), and a flow (the falling flow) which, by means of a sloped portion in the bottom surface of the water conduit in the spout portion, falls toward the inside of the concave portion of the waste receiving surface of the bowl portion by sloping downward toward the concave portion side of the waste receiving surface of the bowl portion. Thereafter, of the flush water flowing into the concave portion of the waste receiving surface on the bowl portion, flush water flowing from the bottom surface of the concave portion toward the front region of the concave portion side wall flows from bottom to top along the sloped surface of the front region of the concave portion side wall and toward the inside of the concave portion, therefore a flow (swirl flow) swirling in the vertical direction within the concave portion is formed without spreading horizontally on the upper waste receiving surface at the outside of the concave portion, after which the flow flows with good force into the inlet of the discharge trap pipe. Through such synergistic effects produced within the concave portion of the waste receiving surface of the bowl portion by the vertical swirl flow of flush water and the swirl flow swirling on the upper waste receiving surface of the bowl portion waste receiving surface, the tendency of flush water in the concave portion of the waste receiving surface of the bowl portion to spread horizontally on the upper waste receiving surface on the outside of the concave portion can be effectively suppressed. Also, a comparatively large flow of flush water can be effectively caused to flow into the discharge trap pipe from the concave portion of the waste receiving surface of the bowl portion, and waste discharge performance can be improved.

In the present invention the bowl portion waste receiving surface is preferably arranged so that the rear region of the wall surface of the concave portion thereof forms a sloped surface sloping inward from the top toward the bottom, and the sloped surface of the front region of the wall surface of the concave portion is disposed along the wall surface positioned forward of the center of the concave portion.

In the present invention thus constituted, flush water spouted from the spout portion water conduit into the rear region of the wall surface in the concave portion of the waste receiving surface of the bowl portion flows with good flow force into the concave portion along the sloped surface sloping inward from top to bottom in the rear region of the wall surface of the concave portion, then flows with good flow force into the inlet of the discharge trap pipe. Of the flush water flowing into the concave portion of the waste receiving surface on the bowl portion, flush water flowing from the bottom surface of the concave portion toward the front region of the concave portion side wall flows from bottom to top and toward the inside of the concave portion due to the sloped surface disposed along the wall surface positioned forward of the concave portion, therefore a flow (swirl flow) swirling in the vertical direction within the concave portion is formed without spreading horizontally on the upper waste receiving surface at the outside of the concave portion, after which the flow flows with good force into the inlet of the discharge trap pipe. As a result of these things, a comparatively large flow of flush water can be more effectively caused to flow into the discharge trap pipe from the concave portion of the waste receiving surface of the bowl portion, and waste discharge performance can be improved.

In the present invention, the waste receiving surface of the bowl portion is preferably arranged so that the bottom surface of the concave portion thereof forms a sloped surface sloping downward toward the inlet to the discharge trap pipe positioned at the rear.

When, in the present invention thus constituted, of the flush water flowing into the concave portion of the waste receiving surface of the bowl portion, the flush water flowing from the bottom surface of the concave portion toward the front region of the concave portion wall surface flows along the sloped surface in the front region of the concave portion wall surface from bottom to top and toward the inside of the concave portion to form a swirl flow, then flows into the inlet of the discharge trap pipe, it flows smoothly into the inlet of the discharge trap pipe because the bottom surface of the concave portion of the waste receiving surface in the bowl portion is sloped downward toward the inlet to the discharge trap pipe positioned to the rear thereof. Therefore a comparatively large flow of flush water can be more effectively caused to flow into the discharge trap pipe from the concave portion of the waste receiving surface of the bowl portion, and waste discharge performance can be improved.

In the present embodiment, the waste receiving surface of the bowl portion is preferably arranged so that the sloped surface of the front region of the wall surface of the concave portion thereof forms a slope angle relative to the vertical wall of the toilet main unit of greater than 0 degrees and less than or equal to 10 degrees.

In the present invention thus constituted, of the flush water flowing into the concave portion of the waste receiving surface of the bowl portion, the flow of flush water flowing from the bottom surface of the concave portion toward the front region of the concave portion wall surface flows along the sloped surface in the front region of the concave portion wall surface, which forms a slope angle of greater than 0 degrees and less than or equal to 10 degrees, thus smoothly forming a swirl flow and enabling a flow into the inlet of the discharge trap pipe. Therefore a comparatively large flow of flush water can be more effectively caused to flow into the discharge trap pipe from the concave portion of the waste receiving surface of the bowl portion, and waste discharge performance can be improved.

In the present invention the rim portion of the bowl portion preferably includes a rim water conduit formed from the rim spout portion along the waste receiving surface, and the rim water conduit includes a guide portion erected in a position horizontally opposing the rim spout portion, and the bottom surface forming the flow in this guide portion includes a sloped portion sloping downward toward the concave portion side of the waste receiving surface of the bowl portion.

In the present invention thus constituted, flush water spouted to the rim portion of the bowl portion from the spout portion flows along the rim water conduit, then is guided into the concave portion of the waste receiving surface of the bowl portion by the sloped portion of the bottom surface of the guide portion, so that flush water inside the rim water conduit can be caused to merge with the vertical swirl flow inside the concave portion. Therefore since a comparatively large flow of flush water can be caused to flow into the discharge trap pipe, waste discharge performance can be improved.

In the present invention, the flush toilet is preferably a siphon-type toilet.

In the present invention thus constituted, because a large flow of flush water can be achieved from the bowl portion into the discharge trap pipe, the onset of the siphon effect when the siphon-type toilet is flushed can be sped up, and waste discharge performance improved.

Advantageous Effect of Invention

According to the flush toilet of the present invention, a comparatively large amount of flush water can be caused to flow from the bowl portion into the discharge trap pipe even when the amount of flush water used to flush the toilet is set at a low level, so that waste discharge performance can be improved.

DESCRIPTION OF EMBODIMENTS

Below, referring to the attached drawings, a flush toilet according to an embodiment of the present invention is explained.

Figure 1:
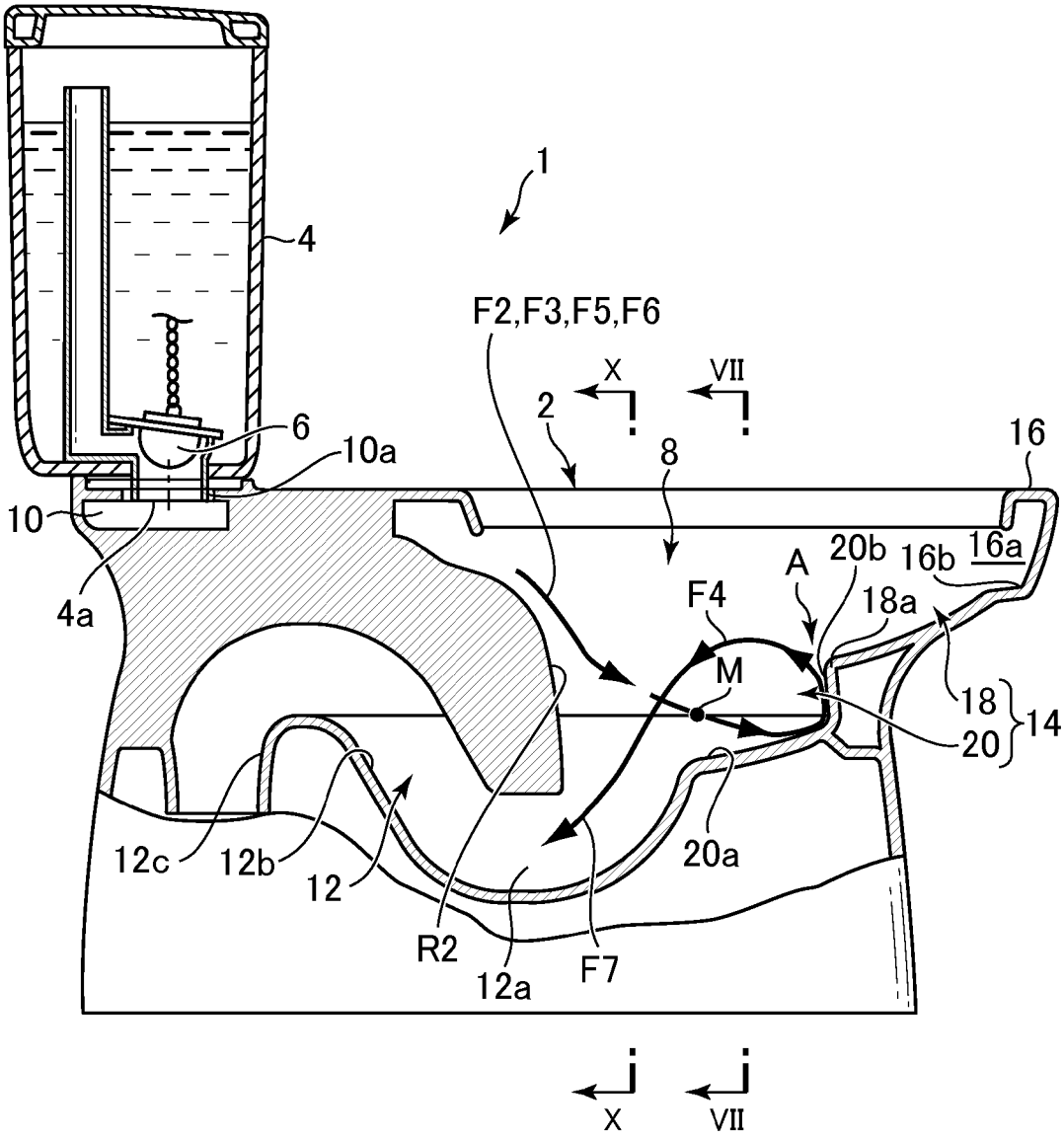
FIG. 1 is a side elevation cross section showing a flush toilet according to an embodiment of the present invention.
Figure 2:
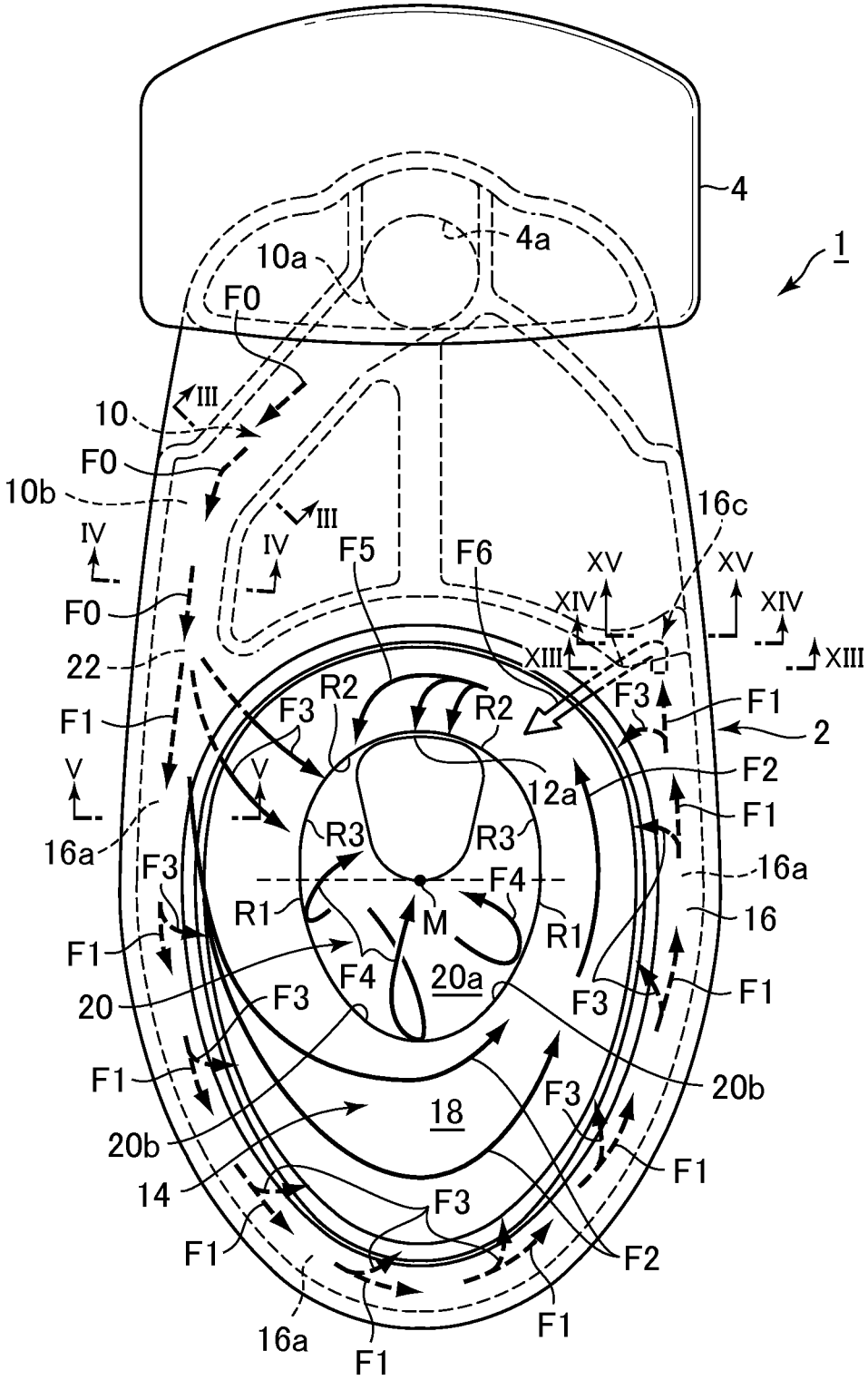
FIG. 2 is a plan view of the flush toilet shown in FIG. 1.

FIG. 1 is a side elevation cross section showing a flush toilet according to an embodiment of the present invention; FIG. 2 is a plan view of the flush toilet shown in FIG. 1.

As shown in FIGS. 1 and 2, the flush toilet 1 according to an embodiment of the present invention is what is known as a siphon-type flush toilet, in which the siphon effect is utilized to pull in waste in the bowl portion and discharge it to the outside in one stroke from the discharge trap pipe, and includes a toilet main unit 2 and a gravity supply-type reservoir tank 4, attached to the rear portion of the toilet main unit 2 and serving as a flush water supply means for holding and supplying flush water.

Also, a discharge valve 6 is erected on the reservoir tank 4; when the discharge valve 6 is opened, flush water stored in the reservoir tank 4 is supplied to the toilet main unit 2.

A bowl portion 8 is formed on the front and top portion of the toilet main unit 2; a water conduit 10 serving as the spouting portion for spouting flush water supplied from the reservoir tank 4 to the bowl portion 8 is formed at the rear and top portion of the toilet main unit 2; and a water discharge trap pipe 12 is formed beneath the bowl portion 8.

The bowl portion 8 includes a reservoir tank 4 and a rim portion 16 formed on the top edge portion thereof; the inner circumferential surface of the rim portion 16 forms an overhang shape so that flush water does not splash outward, and the inside of the rim conduit 16*a* formed along the circumference of the rim portion 16 is open, having a form known as the open rim type.

The waste receiving surface 14 in the bowl portion 8 includes an upper waste receiving surface 18 connected to the rim portion 16, and with a concave portion 20 connected between the upper waste receiving surface 18 and the water discharge trap pipe 12.

Furthermore, the concave portion 20 of the bowl portion 8 waste receiving surface 14, as will be described in detail below, includes a concave portion bottom surface 20*a* positioned below the upper waste receiving surface 18 connected to the water discharge trap pipe 12, and a concave portion wall surface 20*b* connecting this bottom surface 20*a* and the bottom edge portion 18*a* of the upper waste receiving surface 18, whereby the front region R1 of this wall surface 20*b* forms a sloped surface sloping on the inside from bottom to top.

The above-described water discharge trap pipe 12 inlet 12*a* opens rearward and downward on the concave portion 20 of the waste receiving surface 14 in the bowl portion 8; a rise path 12*b* extends rearward from this inlet port 12*a*. A fall path 12*c* connects to this rise path 12*b*, and the bottom end of this fall path 12*c* is connected to an underfloor discharge pipe (not shown) via a discharge socket (not shown).

Note that in the flush toilet 1 of the present embodiment explained herein one example of a floor discharge-type flush toilet in which the bottom end of the fall path 12*c* on a water discharge trap pipe 12 is connected to an underfloor discharge pipe (not shown), but the invention is not limited to this form, and may also be applied to an above-floor discharge-type flush toilet in which the end of the fall path 12*c* is disposed on the rear wall side of the flush toilet and is connected to an above-floor discharge pipe. It is also acceptable for the water supply source supplying flush water to the bowl portion 8 to adopt a structure directly utilizing the supply pressure of the municipal water supply or to provide supplemental pressure with a pump in place of the gravity-fed tank system shown in the embodiment.

As shown in FIG. 2, a spout port 22 by which flush water in the above-described water conduit 10 is spouted to the bowl portion 8 side is formed on the rear portion of the left side as seen from the front of the bowl portion 8.

As shown by flow F0 in FIG. 2, flush water inside the reservoir tank 4 passes from the flush water outflow port 4*a* disposed on the bottom surface of the reservoir tank 4, through the water conduit 10, and from the spout port 22 toward the front direction of the toilet. Flush water spouted from the spout port 22 forms a flow F1 swirling along the rim conduit 16*a* (swirl flow F1) and a flow F2 swirling along the upper waste receiving surface 18 of the bowl portion 8 (swirl flow F2), and a falling flow F3 (falling flow F3) is formed by the spouting of water from the spout port 22 toward the inside of the concave portion 20 of the waste receiving surface 14 on the bowl portion 8.

Next, referring to FIGS. 1 through 5, the above-described water conduit 10, spout port 22 (spout portion), and rim conduit 16*a* are explained in detail.

Figure 3:
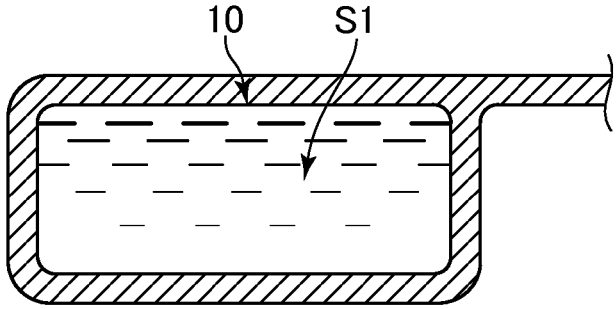
FIG. 3 is a cross section viewed along line III-III in FIG. 2.
Figure 4:
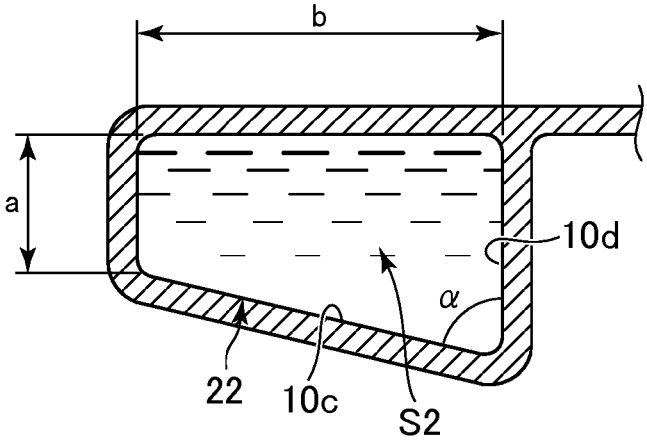
FIG. 4 is a cross section viewed along line IV-IV in FIG. 2.
Figure 5:
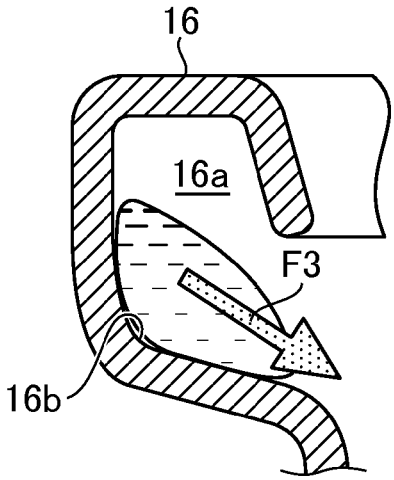
FIG. 5 is a cross section viewed along line V-V in FIG. 2.

FIG. 3 is a cross section viewed along line III-III in FIG. 2. FIG. 4 is a cross section viewed along line IV-IV in FIG. 2. Furthermore, FIG. 5 is a cross section viewed along line V-V in FIG. 2.

First, as shown in FIGS. 2 and 3, a corner portion 10*b* slanted toward the spout port 22 at a position extending a predetermined distance diagonally forward and outside from the inlet portion 10*a* connected to the flush water outflow port 4*a* of the reservoir tank 4 is formed in the water conduit 10. A flow path cross section S1 in the space from the inlet portion 10*a* to the corner portion 10*b* of the water conduit 10 has an elongated flat shape in the left-right direction.

Note that while in the present embodiment each cross section (flow path cross section) over the whole region from the inlet portion 10*a* to the corner portion 10*b* of the water conduit 10 is formed in an elongated flat shape in the left-right direction, this flow path cross section S1, elongated and flat in the left-right direction, may also be formed in a portion of the entire region from the inlet portion 10*a* to the corner portion 10*b* of the water conduit 10; i.e., it is sufficient that the flow path cross section S1 be formed in at least the region necessary for flush water, whose flow is uniformed, to be supplied to the spout port 22.

Also, as shown in FIGS. 2 through 4, the flow cross section S2 in the space from the water conduit 10 corner portion 10*b* to the spout port 22 is elongated and flat in the left-right direction, and the bottom surface 10*c* thereof has a shape which slopes downward toward the concave portion 20 of the bowl portion 8 waste receiving surface 14.

Moreover, the flat flow path cross section S2 from the water conduit 10 corner portion 10*b* to the spout port 22 is expanded in an approximately similar shape facing from upstream to downstream. I.e., the surface area of flow path cross section S2 in the space from the water conduit 10 corner portion 10*b* to the spout port 22 gradually widens toward the downstream side, and is maximal at the spout port 22.

Here, as shown as one example in FIG. 4, it is desirable to set the water conduit 10 flat flow path cross section S2 such that its vertical short side a and horizontal long side b are in a ratio of 0.3 to 0.5; this value is adjusted to match the shape of the bowl portion 8.

It is also desirable to set the angle α formed by the bottom surface 10*c* sloping toward the concave portion 20 side of the bowl portion 8 waste receiving surface 14 to between 60° and 70° relative to the inside surface 10*d*; this value is adjusted to match the shape of the bowl portion 8.

As shown in FIGS. 2 and 5, the rim portion 16 rim conduit 16*a* positioned forward of the spout port 22 is arranged so that over essentially the entire region the rim conduit bottom surface 16*b* slopes downward toward the concave portion 20 of the bowl portion 8 waste receiving surface 14, as does the spout port 22 bottom surface 10*c*. Flush water flowing into the rim conduit 16*a* from the spout port 22 flows in a flow F1 along the inside of the rim conduit 16*a*, while at the same time a portion thereof flows in a flow F3 toward the inside of the concave portion 20 of the bowl portion 8 waste receiving surface 14.

The rim conduit 16*a* includes a guide portion 16*c* (described in detail below) at a position facing the spout port 22 in the horizontal direction.

Next, referring to FIG. 1, FIG. 2, and FIGS. 6 through 12, the concave portion 20 of the bowl portion 8 waste receiving surface 14 is explained in detail.

Figure 6:
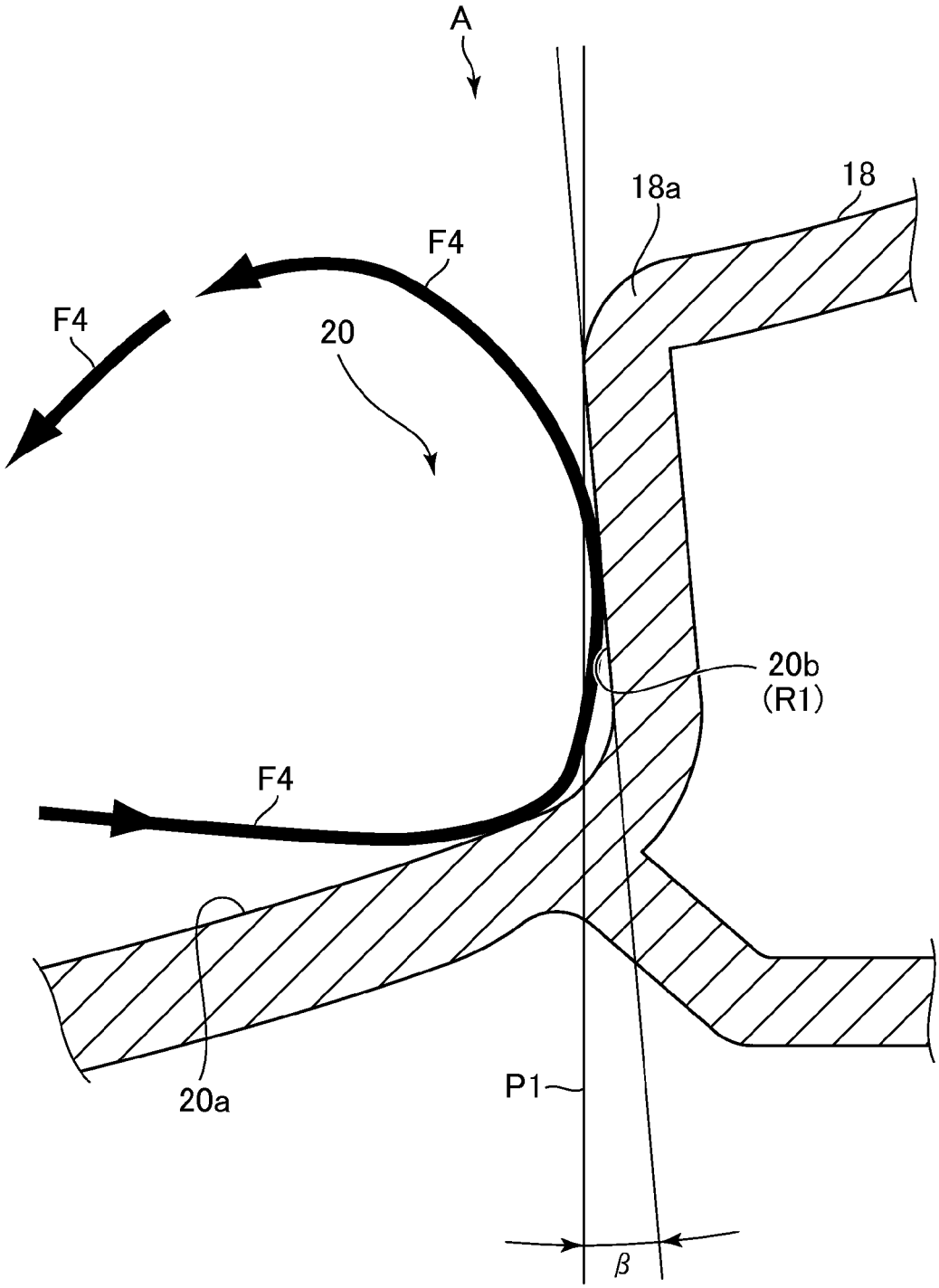
FIG. 6 is an expanded view of the A portion of the flush toilet according to the embodiment of the present invention shown in FIG. 1.

FIG. 6 is an expanded view of the A portion of the flush toilet according to the embodiment of the present invention shown in FIG. 1.

Figure 7:
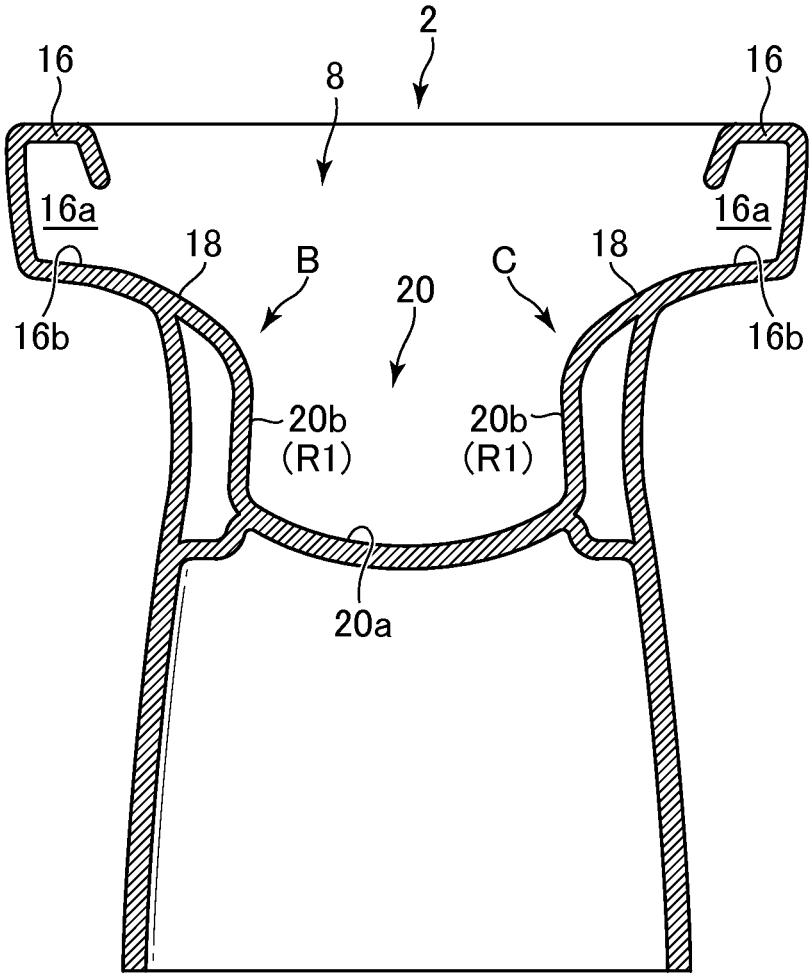
FIG. 7 is a cross section viewed along line VII-VII in FIG. 1.
Figure 8:
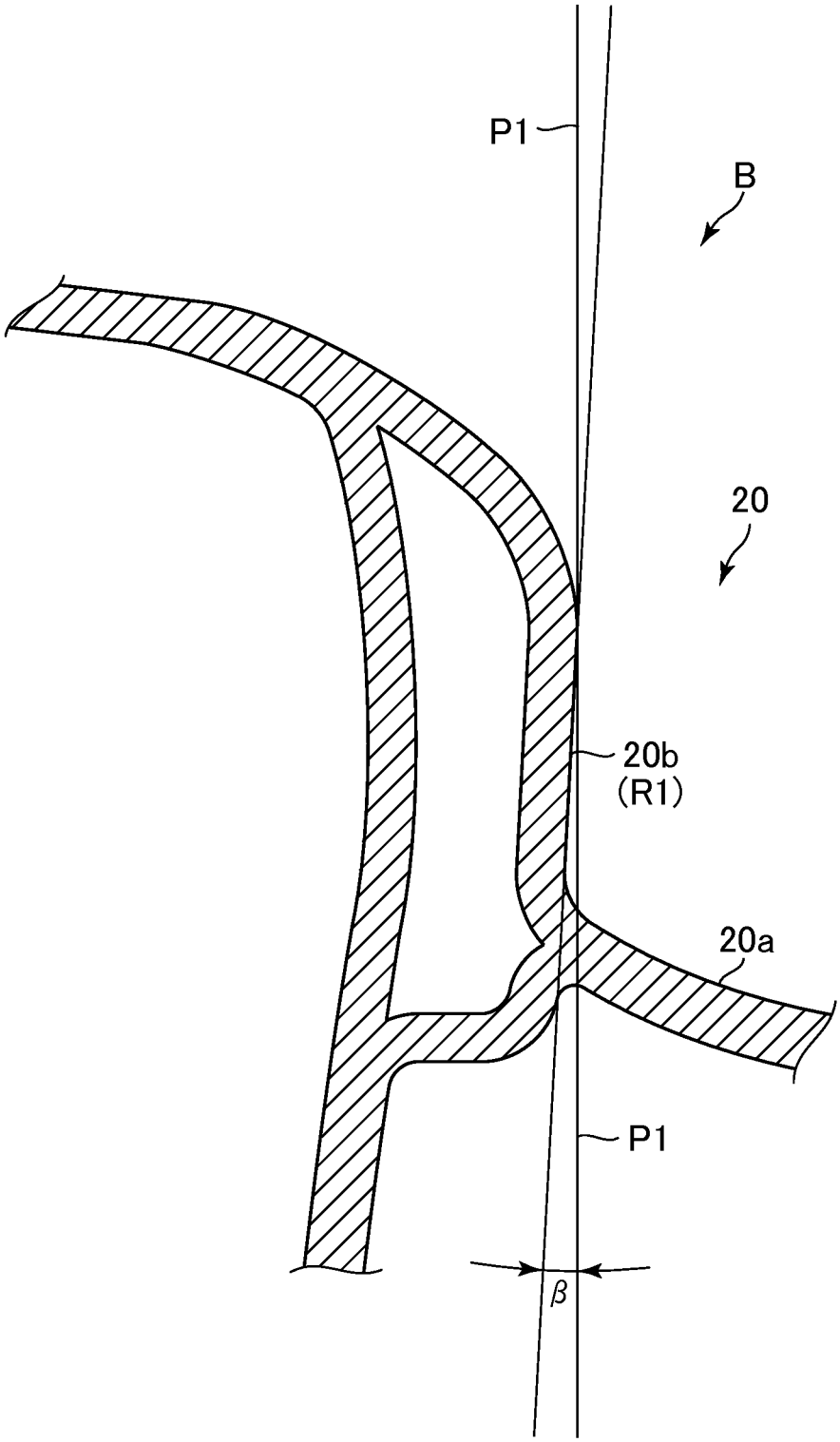
FIG. 8 is an expanded view of the B portion of the flush toilet according to the embodiment of the present invention shown in FIG. 7.
Figure 9:
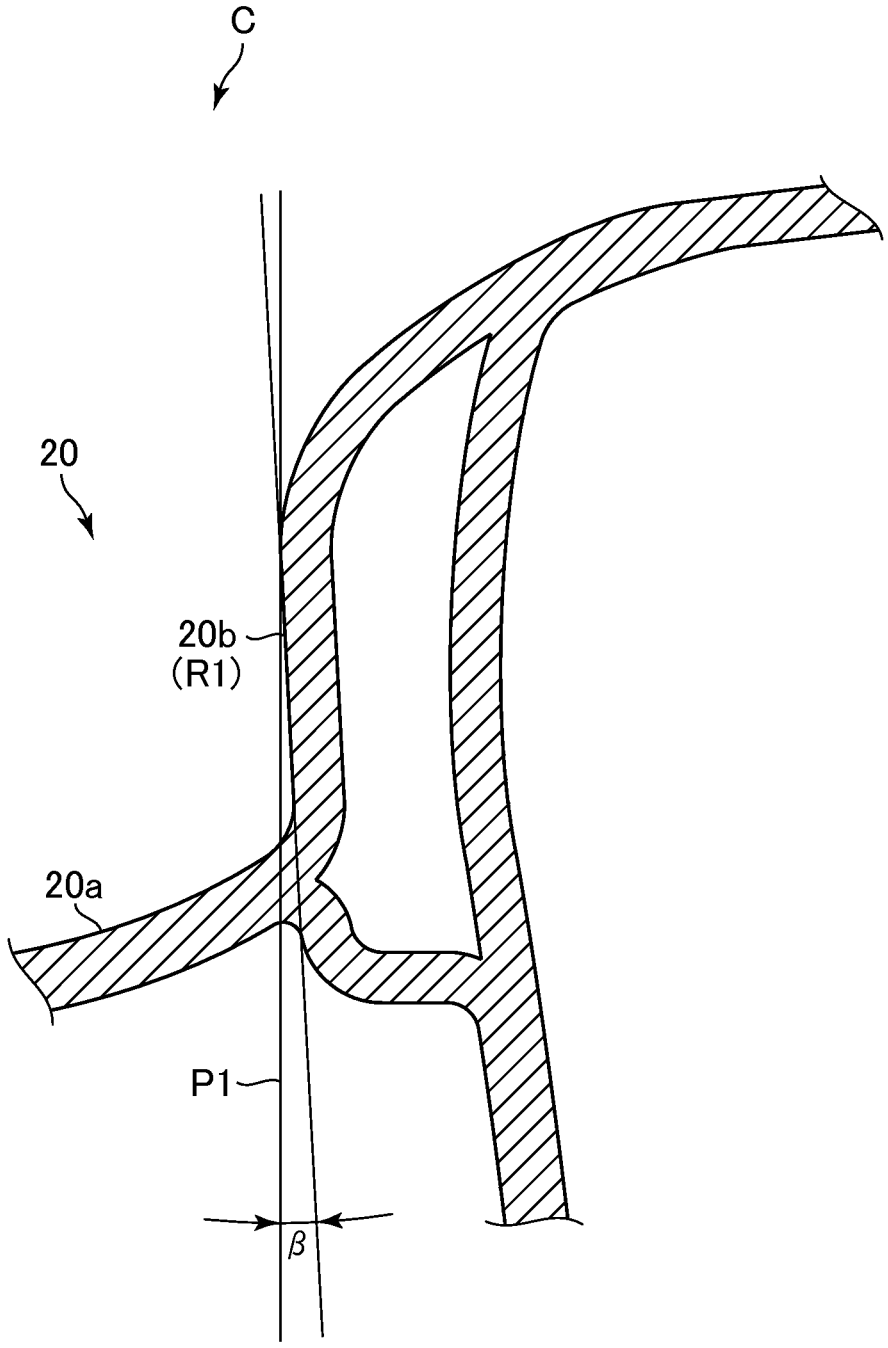
FIG. 9 is an expanded view of the C portion of the flush toilet according to the embodiment of the present invention shown in FIG. 7.

FIG. 7 is a sectional diagram viewed along line VII-VII in FIG. 1; FIG. 8 is an expanded diagram of part B of the flush toilet according to the embodiment of the present invention shown in FIG. 7; and FIG. 9 is an expanded diagram of part C of the flush toilet according to the embodiment of the present invention shown in FIG. 9.

Figure 10:
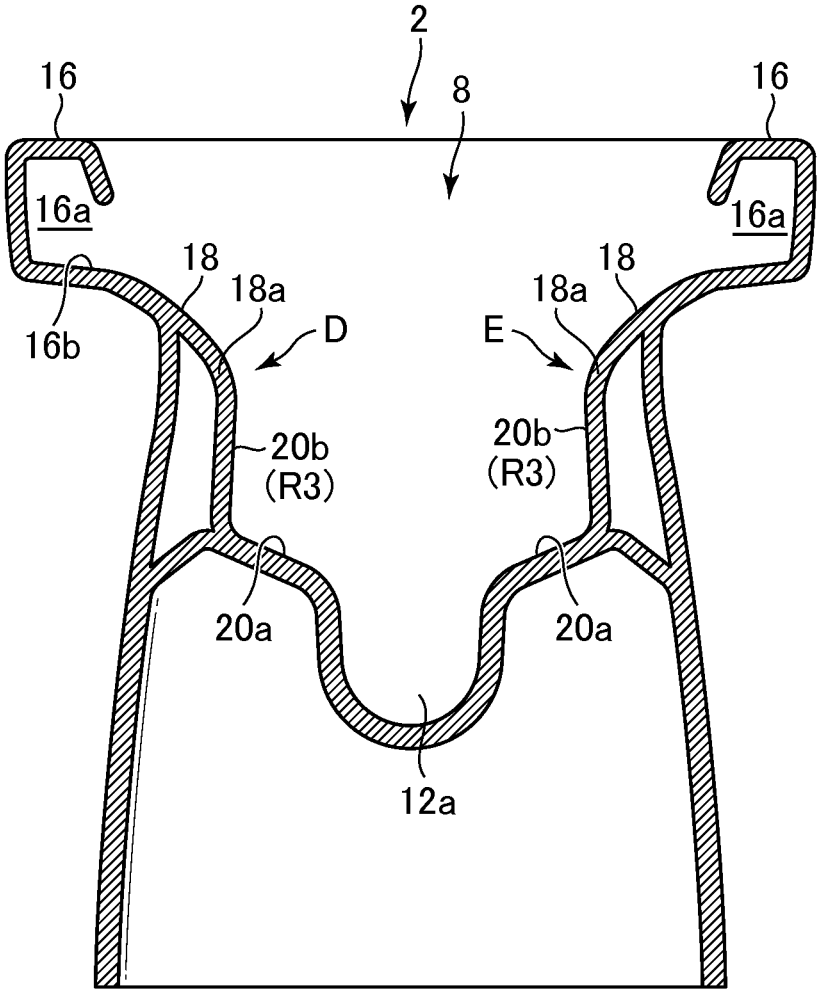
FIG. 10 is a cross section viewed along line X-X in FIG. 1.
Figure 11:
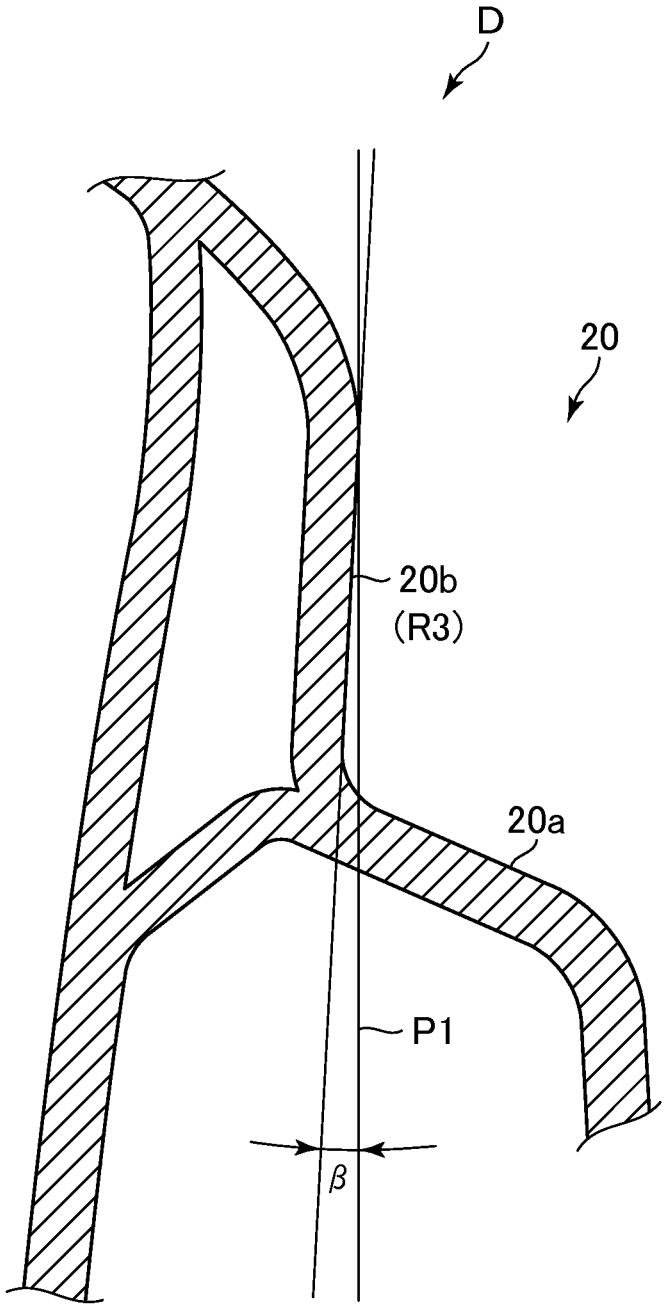
FIG. 11 is an expanded view of the D portion of the flush toilet according to the embodiment of the present invention shown in FIG. 10.
Figure 12:
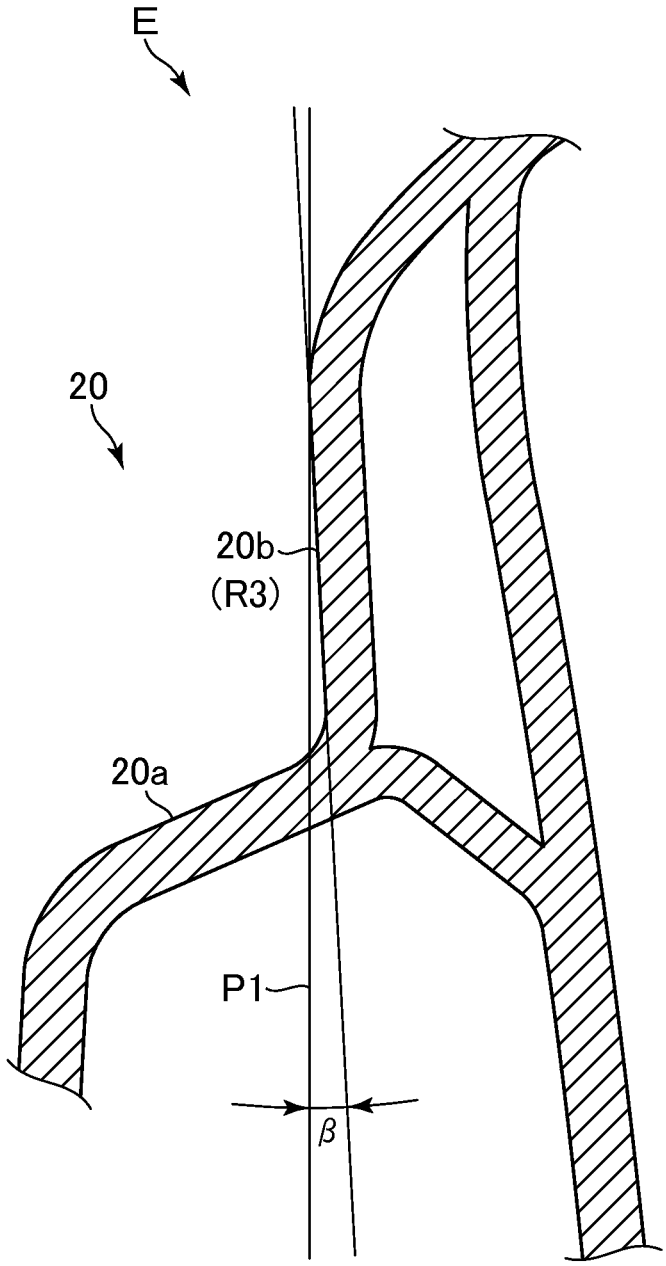
FIG. 12 is an expanded view of the E portion of the flush toilet according to the embodiment of the present invention shown in FIG. 10.

Furthermore, FIG. 10 is a sectional diagram viewed along line X-X in FIG. 1; FIG. 11 is an expanded diagram of part D of the flush toilet according to the embodiment of the present invention shown in FIG. 10; and FIG. 12 is an expanded diagram of part E of the flush toilet according to the embodiment of the present invention shown in FIG. 10.

As shown in FIGS. 1 and 6, the concave portion 20 of the bowl portion 8 waste receiving surface 14 includes a concave portion bottom surface 20*a*, positioned below the upper waste receiving surface 18 connected to the water discharge trap pipe 12, and a concave portion wall surface 20*b* connecting this bottom surface 20*a* and the bottom edge portion 18*a* of the upper waste receiving surface 18.

The bottom surface 20*a* of the concave portion 20 forms a sloped surface sloping downward toward the water discharge trap pipe 12 inlet 12*a* positioned at the rear.

Furthermore, as shown in FIGS. 2 and 6, the region R1 ("front region R1" below) of the wall surface 20*b* positioned on the front side of at least the center portion M of the concave portion 20 forms a sloped surface sloping on the inside (inward on the concave portion 20) from bottom to top. Flush water which has flowed into the concave portion 20 from the spout port 22, by flowing from the concave portion 20 bottom surface 20*a* toward the front region R1 of the concave portion 20 wall surface 20*b*, then flowing along the sloped surface of the wall surface 20*b* from bottom to top and toward the inside of the concave portion 20, forms a flow F4 (swirl flow) swirling in the vertical direction, after which it flows with good flow force into the water discharge trap pipe 12 inlet 12*a*.

At the same time, the region R2 ("rear region R2" below) forming the wall surface 20*b* at the rear of the concave portion 20 forms a sloped surface sloping on the inside, facing from bottom to top. Flush water spouted from the spout port 22 forms flows F1 and F2 swirling along the upper waste receiving surface 18, or falling flow F3 falling from the spout port 22, then reaches the wall surface 20*b* at the rear side of the concave portion 20, after which it forms a flow F5 and flows with good force toward the interior of the concave portion 20, and flows with good force into the water discharge trap pipe 12 inlet 12*a*.

Next, as shown in FIG. 1 and FIGS. 6 through 9, the sloped surface of the front region R1 of the concave portion 20 wall surface 20*b* slopes at a predetermined slope angle β relative to vertical surface P1 of the toilet main unit 2 so as to slope along the circumferential direction of the front region R1 wall surface 20*b* and toward the inside (toward the inside of the concave portion 20) from bottom to top.

Here it is preferable to set the slope angle β to be greater than 0 degrees and less than or equal to 15 degrees, and most preferably to greater than 0 degrees and less than or equal to 10 degrees.

Similarly, as shown in FIGS. 10 through 12, the wall surface 20*b* in the intermediate region R3 between the front region R1 and the rear region R2 of the concave portion 20 wall surface 20*b*, as with the front region R1 wall surface 20*b*, is sloped at a predetermined slope angle β relative to the vertical surface P1 of the toilet main unit 2 so as to slope toward the inside (inward on the concave portion 20) from bottom to top.

Note that with respect to the wall surface 20*b* of this intermediate region R3, a setting which does not produce sloping (slope angle β=0 degrees) is also acceptable.

The slope angles β of the concave portion 20 front region R1 and intermediate region R3 are not limited to settings at a fixed angle along the circumferential direction of the wall surface 20*b*, and may also be continuously varied along the circumferential direction of the wall surface 20*b* in a predetermined range of angles greater than 0 degrees and less than or equal to 10 degrees.

Next, referring to FIG. 2 and FIGS. 13 through 15, the guide portion 16*c* of the rim conduit 16*a* on the rim portion 16 is explained in detail.

The guide portion 16*c* of the rim conduit 16*a* on the rim portion 16 is disposed at the downstream end side (the rear side) within the rim conduit 16*a* facing the spout port 22 in the horizontal direction. The bottom surface forming the flow path 16*d* in the guide portion 16*c* forms a sloped surface 16*e* sloping downward toward the concave portion 20 side of the bowl portion 8 waste receiving surface 14.

Figure 13:
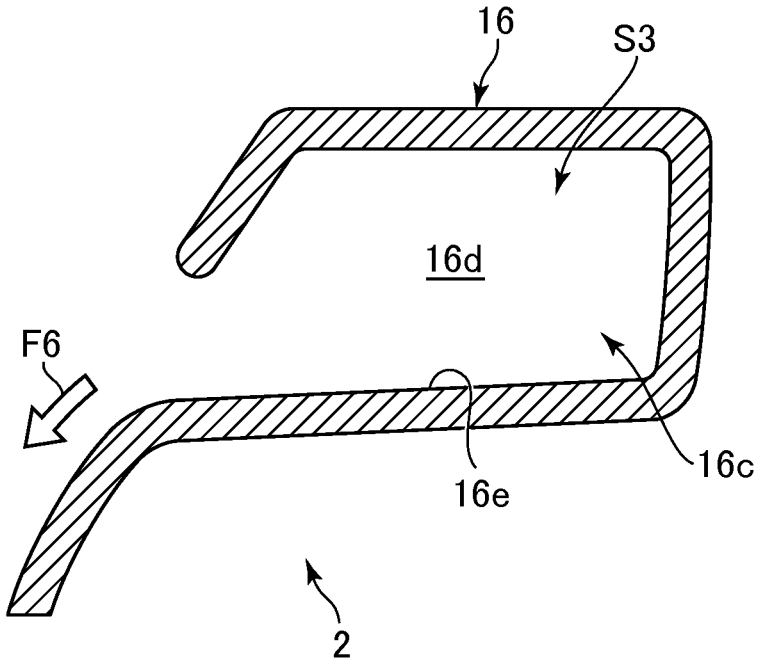
FIG. 13 is a cross section viewed along line XIII-XIII in FIG. 2.
Figure 14:
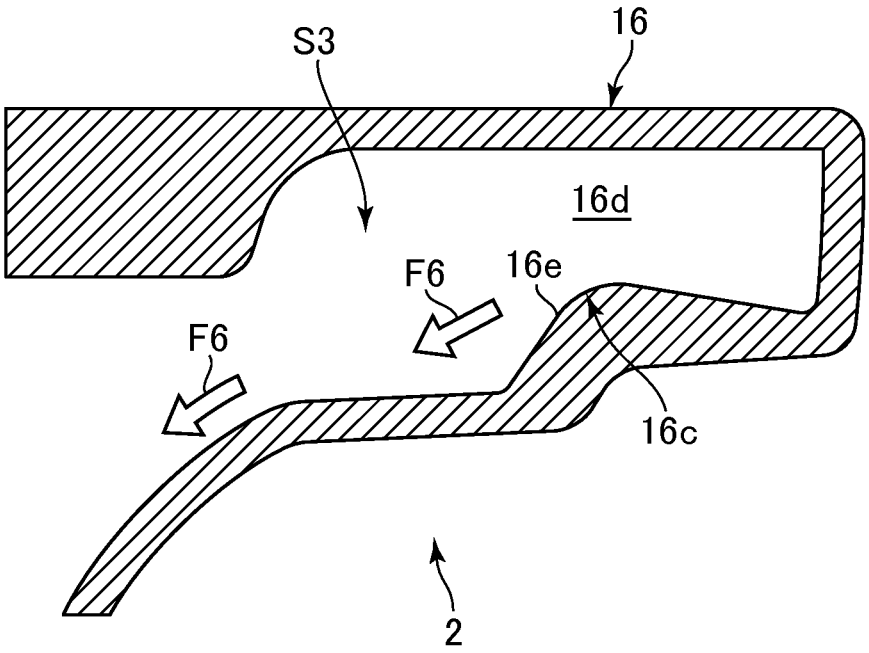
FIG. 14 is a cross section viewed along line XIV-XIV in FIG. 2.
Figure 15:
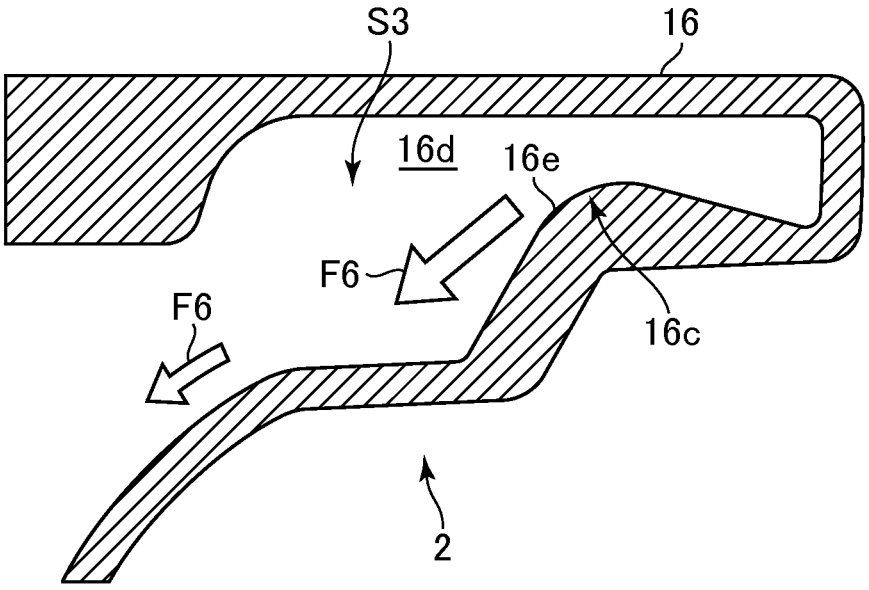
FIG. 15 is a cross section viewed along line XV-XV in FIG. 2.

Advancing from the upstream side shown in FIG. 13 to the downstream side shown in FIG. 15 via the intermediate space shown in FIG. 14, the downward slope toward the concave portion 20 increases at the sloped surface 16*e* of the guide portion 16*c*, and the cross-sectional area of the guide portion 16*c* flow path cross section S3 gradually decreases advancing toward the downstream side.

Flush water spouted from the spout port 22 to the rim conduit 16*a* forms a swirl flow F1 and reaches the guide portion 16*c* and, by flowing along the sloped surface 16*e* of the guide portion 16*c*, forms a flow F6 (falling flow F6) sloping downward to the concave portion 20 side and is guided into the concave portion 20. This falling flow F6, by merging with the vertical swirl flow F4 inside the concave portion 20, flows with good flow force into the inlet 12*a* of the water discharge trap pipe 12 (see flow F7 in FIG. 1).

Next, referring to FIGS. 1 through 16, the operation of a flush toilet according to an embodiment of the present invention is explained.

Figure 16:
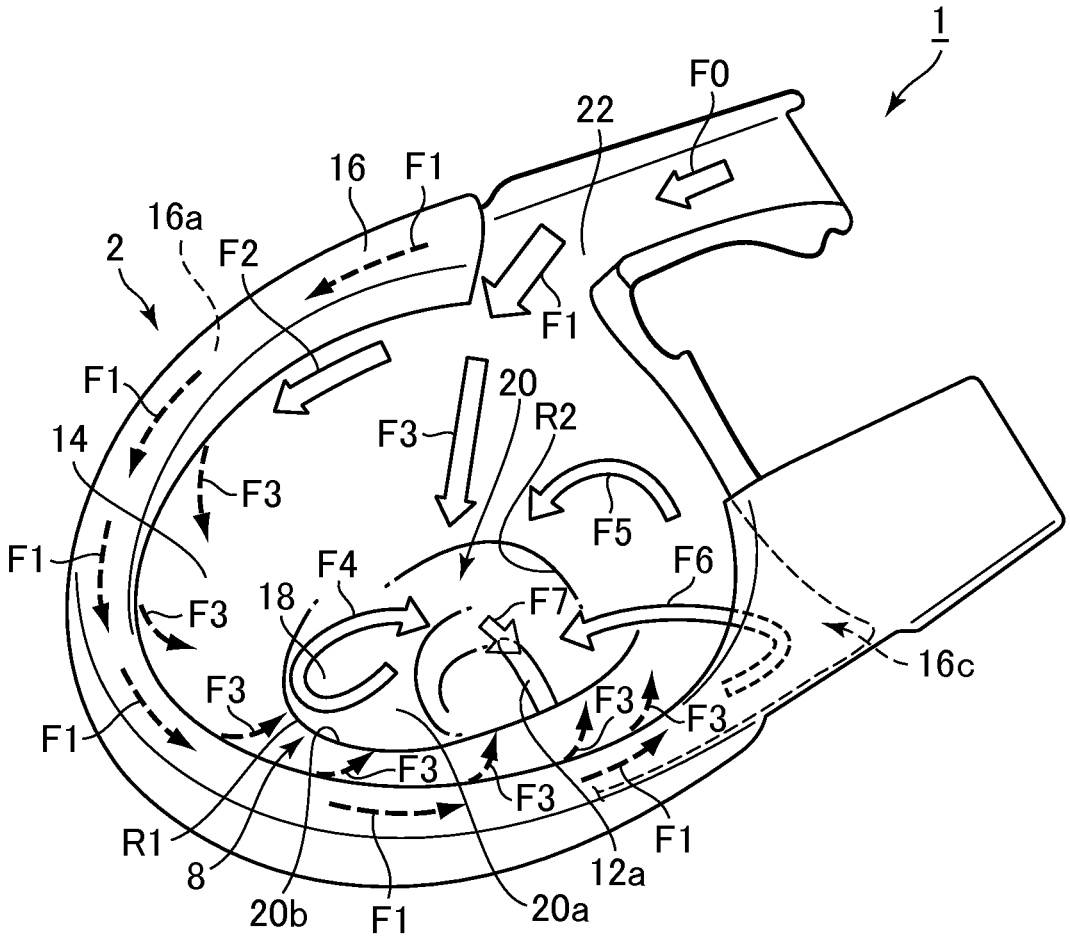
FIG. 16 is a summary perspective view showing the appearance of the flush water flow in a flush toilet according to an embodiment of the present invention.

FIG. 16 is a summary perspective view showing the appearance of the flush water flow in a flush toilet according to an embodiment of the present invention.

When the operating lever (not shown) to flush the toilet is first operated, the discharge valve 6 provided on the reservoir tank 4 opens, and flush water in the reservoir tank 4 flows into the water conduit 10 inlet portion 10*a* from the flush water outflow port 4*a* through the corner portion 10*b* of the water conduit 10 (see arrow F1) to be spouted from the spout port 22. At this point, because the cross section in the interval from the water conduit 10 inlet portion 10*a* to the corner portion 10*b* has an elongated flat shape in the left-right direction, flush water flowing in the water conduit 10 in this interval is configured into a flattened flush water flow in the flat portion of the water conduit 10, and when spouted from the spout port 22 has a flattened form which broadens in the left-right direction but does not broaden in the up-down direction.

Flush water spouted from the spout port 22 is spouted from the spout port 22 in the toilet front direction onto the inner circumferential surface between the rim portion 16 and the waste receiving surface 14 in a horizontal flow; this water forms a swirl flow F1 swirling in the rim conduit 16*a* which is on the outer circumference side of the bowl portion 8 and a swirl flow F2 swirling on the upper waste receiving surface 18, while also forming a falling flow F3 which slopes downward along the spout port 22 bottom surface 10*c* and the rim conduit 16*a* bottom surface 16*b* toward the concave portion 20 side, then drops.

Furthermore, flush water which has flowed into the concave portion 20 from the spout port 22, by flowing from the concave portion 20 bottom surface 20*a* toward the front region R1 of the concave portion 20 wall surface 20*b*, then flowing along the sloped surface of the wall surface 20*b* from bottom to top and toward the inside of the concave portion 20, forms a flow F4 (swirl flow) swirling in the vertical direction, after which it flows with good flow force into the water discharge trap pipe 12 inlet 12*a*. Thereafter this vertical swirl flow F4 flows with good flow force into the inlet 12*a* of the water discharge trap pipe 12.

At the same time, when the swirl flow F2 swirls to the vicinity of the rear side of the upper waste receiving surface 18 of the bowl portion 8, it drops toward the inside of the concave portion 20 and becomes flow F5.

The swirl flow F1, having flowed from the spout port 22 along the rim conduit 16*a* to reach the guide portion 16*c*, flows along the sloped surface 16*e* of the guide portion 16*c* and becomes flow F6, sloping downward toward the inside of the concave portion 20.

Moreover, this falling flow F6, by merging with the vertical swirl flow F4 inside the concave portion 20, flows with good flow force into the inlet 12*a*, becoming flow F7.

At this time, waste which has collected around the center portion M of the concave portion 20 prior to flowing into the water discharge trap pipe 12 inlet 12*a* is effectively sent into the water discharge trap pipe 12 inlet 12*a* by siphon suction force and by the pushing force with which it is pushed by the flow F7 toward the water discharge trap pipe 12 inlet 12*a*.

According to the flush toilet 1 of the present embodiment of the above-described present invention, of the flush water flowing from the spout port 22 into the concave portion 20 on the waste receiving surface 14 in the bowl portion 8, the flush water flowing from the bottom surface 20*a* of the concave portion 20 toward the front region R1 of the wall surface 20*b* of the concave portion 20 flows from bottom to top along the sloped surface of the front region R1 of the wall surface 20*b* of the concave portion 20 and toward the inside of the concave portion 20, and therefore forms a flow (vertical swirl flow) F4 swirling in the vertical direction within the concave portion 20, without spreading horizontally on the upper waste receiving surface 18 outside the concave portion 20. Thereafter, this vertically swirling flow of flush water can, by flowing at high flow force into the inlet 12*a* of the discharge trap pipe 12, cause a comparatively large amount of flush water to flow into the discharge trap pipe 12, thus improving waste discharge performance.

Also, according to the flush toilet 1 of the present embodiment, flush water spouted to the bowl portion 8 from the water conduit 10, which includes a flow path cross section S1 having an elongated flat shape in the horizontal width direction of the toilet main unit 2, forms flows F1 and F2 swirling on the outer circumference side of the bowl portion (e.g. the rim conduit 16*a* or upper waste receiving surface 18 of the bowl portion 8), and the sloped bottom surface 10*c* of the water conduit 10 slopes downward toward the concave portion 20 of the waste receiving surface 14 in the bowl portion 8, thereby forming a flow F3 (falling flow) which falls toward the inside of the concave portion 20 on the waste receiving surface 14 in the bowl portion 8. Thereafter, of the flush water flowing into the concave portion 20 on the waste receiving surface 14 in the bowl portion 8, the flush water flowing from the bottom surface 20*a* of the concave portion 20 toward the front region R1 of the wall surface 20*b* of the concave portion 20 flows from bottom to top along the sloped surface of the front region R1 of the wall surface 20*b* of the concave portion 20 and toward the inside of the concave portion 20, and therefore forms a flow (vertical swirl flow) F4 swirling in the vertical direction within the concave portion 20, without spreading horizontally on the upper waste receiving surface 18 outside the concave portion 20; it is then able to flow into the water discharge trap pipe 12 inlet 12*a* with good flow force. Through this synergistic effect produced within the concave portion 20 of the waste receiving surface 14 in the bowl portion 8 by the vertical swirl flow of the flush water and the swirl flow swirling on the upper waste receiving surface 18 of the bowl portion 8 waste receiving surface 14, the tendency of flush water in the concave portion 20 of the waste receiving surface 14 in the bowl portion 8 to spread horizontally on the upper waste receiving surface 18 on the outside of the concave portion 20 can be effectively suppressed. Also, a comparatively large flow of flush water can be effectively caused to flow into the discharge trap pipe 12 from the concave portion 20 of the waste receiving surface 14 in the bowl portion 8, and waste discharge performance can be improved.

Furthermore, according to the flush toilet 1 of the present embodiment, flush water spouted from the spout port 22 on the water conduit 10 into the rear region R2 of the wall surface 20*b* of the concave portion 20 of the waste receiving surface 14 on the bowl portion 8, after flowing into the concave portion 20 from top to bottom in the rear region R2 of the concave portion 20 wall surface 20*b* along the inwardly sloped surface under good flow force (see flows F3, F5), flows with good flow force into the water discharge trap pipe 12 inlet 12*a*. Also, of the flush water flowing into the concave portion 20 on the waste receiving surface 14 in the bowl portion 8, the flush water flowing from the bottom surface 20*a* of the concave portion 20 toward the front region R1 of the wall surface 20*b* of the concave portion 20 flows from bottom to top along the wall surface 20*b* positioned forward of the center portion M of the concave portion 20 and toward the inside thereof, thereby forming a flow (vertical swirl flow) F4 swirling in the vertical direction within the concave portion 20 without spreading horizontally on the upper waste receiving surface 18 outside the concave portion 20, after which it flows into the water discharge trap pipe 12 inlet 12*a* with good flow force. As the result of these things, a comparatively large flow of flush water can be more effectively caused to flow into the discharge trap pipe 12 from the concave portion 20 of the waste receiving surface 14 in the bowl portion 8, and waste discharge performance can be improved.

According to the flush toilet 1 of the present embodiment, of the flush water which has flowed into the concave portion 20 of the waste receiving surface 14 in the bowl portion 8, the flush water which flowed from the concave portion 20 bottom surface 20*a* toward the front region R1 of the wall surface 20*b* forms a vertical swirl flow F4 flowing along the sloped surface of the front region R1 of the concave portion 20 wall surface 20*b* from bottom to top and toward the inside of the concave portion 20, after which when flowing into the water discharge trap pipe 12 inlet 12*a*, it can smoothly flow into the water discharge trap pipe 12 inlet 12*a* due to the fact that the bottom surface 20*a* of the concave portion 20 on the waste receiving surface 14 in the bowl portion 8 slopes downward toward the inlet 12*a* of the water discharge trap pipe 12 positioned to the rear thereof. Therefore a comparatively large flow of flush water can be more effectively caused to flow into the discharge trap pipe 12 from the concave portion 20 of the waste receiving surface 14 in the bowl portion 8, and waste discharge performance can be improved.

Furthermore, according to the flush toilet 1 of the present embodiment, of flush water which has flowed into the concave portion 20 of the waste receiving surface 14 in the bowl portion 8, the flush water which flows from the bottom surface 20*a* of the concave portion 20 toward the front region R1 of the wall surface 20*b*, by flowing from bottom to top along the sloped surface of the front region R1 of the concave portion 20 wall surface 20*b*, which forms a slope angle β of greater than 0 degrees and less than or equal to 10 degrees relative to the vertical surface P1 of the toilet main unit 2, smoothly forms a vertical swirl flow F4, and can thus flow into the inlet 12*a* of the water discharge trap pipe 12. Therefore a comparatively large flow of flush water can be more effectively caused to flow into the discharge trap pipe 12 from the concave portion 20 of the waste receiving surface 14 in the bowl portion 8, and waste discharge performance can be improved.

Also, according to the flush toilet 1 of the present embodiment, the flush water spouted from the spout port 22 to the bowl portion 8 rim portion 16 flows along the rim conduit 16*a*, then is guided within the concave portion 20 of the waste receiving surface 14 in the bowl portion 8 by the sloped surface 16*e* of the guide portion 16*c*, becoming falling flow F6, which slopes downward to the concave portion 20 side, and can merge with the vertical swirl flow F4 inside the concave portion 20. Therefore since a comparatively large flow of flush water can be caused to flow as flow F7 into the discharge trap pipe 12 from the concave portion 20, waste discharge performance can be improved.

Also, according to the flush toilet 1 of the present embodiment, because a large flow of flush water can be achieved from the concave portion 20 of the bowl portion 8 into the discharge trap pipe 12, onset of the siphon effect when the siphon-type toilet is flushed can be sped up, and waste discharge performance improved.

Note that in the flush toilet 1 according to the above-described embodiment it is explained as an example a form in which the invention is applied to a siphon flush toilet, but the invention is not limited to this configuration, and may be applied to other flush toilet configurations.

For example, it can be applied to toilet configurations other than siphon flush toilets, such as what is known as wash-down type toilets, in which waste is pushed out by the flow effect caused by the falling of water within the bowl portion. It is also possible to form, at a position above the reservoir portion of the bowl portion, a jet spouting port for spouting flush water supplied via a water conduit, applying same to the flush toilet so that flush water spouted from this jet spouting port produces a swirl flow causing the water held in the reservoir portion to swirl in an up and down direction. In this case, because the swirl flow supplied from the jet spouting port and swirling in the up and down direction flows along the sloped surface of the concave portion wall surface from bottom to top and toward the inside of the concave portion, a flow swirling in the vertical direction is formed inside the concave portion. Thereafter, this vertically swirling flow of flush water can, by flowing at high flow force into the inlet of the discharge trap pipe, cause a comparatively large amount of flush water to flow into the discharge trap pipe, thus improving waste discharge performance.

Also, in the rim portion 16 of the flush toilet 1 according to the above-described present embodiment, it is explained as an example what is known as the open-type configuration, in which the inner circumferential surface of the rim portion 16 is formed in an overhanging shape so that flush water does not splash out, and the inside of the rim conduit 16*a* formed along the circumferential direction of the rim portion 16 is open, but the invention is not limited to such configurations, and may also be applied to other configurations. In other words, what is known as a rimless configuration rim portion embodiment, in which the edge part of the rim portion is not shaped as an overhang, is also acceptable as another configuration of the rim portion. Alternatively, the invention may also be applied to what is known as a box rim type of configuration, in which numerous water discharging holes are disposed in a closed box-shaped water conductor formed along the circumferential surface of the rim portion, and water is spouted by dropping from these water discharging holes.

Although the present invention has been explained with reference to specific, preferred embodiments, one of ordinary skill in the art will recognize that modifications and improvements can be made while remaining within the scope and spirit of the present invention. The scope of the present invention is determined solely by appended claims.

What is claimed is:

1. A flush toilet in which a toilet main unit is cleaned by flush water supplied from a flush water supply, thereby discharging waste, the flush toilet comprising:

a bowl portion including a waste receiving surface and a rim portion positioned at a top edge portion of the bowl portion;

a spout portion for spouting flush water supplied from the flush water supply to the bowl portion; and a water discharge trap pipe for discharging waste, the water discharge trap pipe including an inlet connected at a bottom of the bowl portion;

the waste receiving surface on the bowl portion including an upper waste receiving surface connected to the rim portion, and a concave portion connected between the upper waste receiving surface and the water discharge trap pipe; and the concave portion having a center and including a bottom surface connected to the water discharge trap pipe and positioned below the upper waste receiving surface, and a wall surface connecting the bottom surface with a bottom edge portion of the upper waste receiving surface; and a front region of said wall surface forming a sloped surface sloping inwardly from bottom to top and inward in a direction toward the center of the concave portion so that the bottom of the sloped surface is further away from the center of the concave portion than the top of the sloped surface.

2. The flush toilet according to claim 1, wherein the water spout portion forms a water conduit including an elongated, flat flow path cross section in the horizontal direction of the toilet main unit so that spouted flush water forms a swirl flow on the outer circumference of the bowl portion, and a falling flow falling in the direction of the concave portion, and a bottom surface of said water conduit includes a sloped portion sloping downward toward a side of the concave portion of the waste receiving surface of the bowl portion.

3. The flush toilet according to claim 1, wherein the bowl portion waste receiving surface is arranged so that a rear region of the wall surface of the concave portion thereof forms a sloped surface sloping inward from the top toward the bottom, and the sloped surface of the front region of the wall surface of the concave portion is disposed along the wall surface positioned forward of the center of the concave portion.

4. The flush toilet according to claim 1, wherein the waste receiving surface of the bowl portion is arranged so that the bottom surface of the concave portion forms a sloped surface sloping downward toward the inlet to the water discharge trap pipe positioned at the rear of the toilet main unit.

5. The flush toilet according to claim 1, wherein the waste receiving surface of the bowl portion is arranged so that the sloped surface of the front region of the wall surface of the concave portion thereof forms a slope angle relative to a vertical wall of the toilet main unit of greater than 0 degrees and less than or equal to 10 degrees.

6. The flush toilet according to claim 1, wherein the rim portion of the bowl portion includes a rim water conduit formed from a rim spout portion along the waste receiving surface; the rim water conduit includes a guide portion erected in a position horizontally opposing the rim spout portion; and a bottom surface forming the flow in the guide portion includes a sloped portion sloping downward toward the concave portion side of the waste receiving surface of the bowl portion.

7. The flush toilet according to claim 1, wherein the flush toilet is a siphon toilet.

* * * * *